US010443980B2

(12) United States Patent
Noller

(10) Patent No.: US 10,443,980 B2
(45) Date of Patent: Oct. 15, 2019

(54) SYSTEM FOR SCOPE LEVELING

(71) Applicant: Japan Optics USA LLC, West Newton, MA (US)

(72) Inventor: Martin Noller, West Newton, MA (US)

(73) Assignee: Japan Optics USA LLC, West Newton, MA (US)

( * ) Notice: Subject to any disclaimer, the term of this patent is extended or adjusted under 35 U.S.C. 154(b) by 0 days.

(21) Appl. No.: 16/165,355

(22) Filed: Oct. 19, 2018

(65) Prior Publication Data

US 2019/0226806 A1 Jul. 25, 2019

Related U.S. Application Data

(63) Continuation of application No. 16/038,235, filed on Jul. 18, 2018.

(60) Provisional application No. 62/619,941, filed on Jan. 22, 2018.

(51) Int. Cl.

| | |
|---|---|
| ***G02B 23/00*** | (2006.01) |
| ***F41G 1/44*** | (2006.01) |
| ***F41G 1/54*** | (2006.01) |
| ***F41G 11/00*** | (2006.01) |
| ***F41G 1/387*** | (2006.01) |

(52) U.S. Cl.

CPC ..... *F41G 1/44* (2013.01); *F41G 1/387* (2013.01); *F41G 1/545* (2013.01); *F41G 11/003* (2013.01)

(58) Field of Classification Search

CPC ... F41G 1/35; F41G 1/16; F41G 3/065; F41G 1/44; F41G 1/545; F41G 11/003; F41A 5/28; F21Y 2115/10; B29L 2031/777; G06F 3/1423

USPC ..... 359/430; 42/90, 111, 122–128; 33/533, 33/645

See application file for complete search history.

(56) References Cited

U.S. PATENT DOCUMENTS

2002/0100203 A1* 8/2002 Harris ..... F41G 11/001 42/125
2008/0022576 A1* 1/2008 Epling ..... F41G 1/38 42/124

* cited by examiner

*Primary Examiner* — Mustak Choudhury
(74) *Attorney, Agent, or Firm* — Braxton Perrone, PLLC

(57) ABSTRACT

A system and method for scope leveling. The scope has a scope body. The scope body has a leveling indicator. In one example, the leveling indicator is an engraved line which extends longitudinally along the length of the scope. The scope is manipulated such that the leveling indicator is properly aligned relative to a mount. The system and method results in a level scope which reduces canted angles and increases accuracy.

13 Claims, 3 Drawing Sheets

SYSTEM FOR SCOPE LEVELING

PRIORITY

This application is a continuation of U.S. application Ser. No. 16/038,235 filed Jul. 18, 2018 which claims priority to U.S. Ser. No. 62/619,941 filed Jan. 22, 2018, the entirety of each of these is hereby incorporated by reference.

BACKGROUND OF THE INVENTION

Technical Field

The present invention relates to a system and method for leveling a scope.

Description of Related Art

Rifles and other firearms use scopes to aid in the shooter's aim. However, if a scope is mounted incorrectly, the projectile, such as a bullet, will not hit the desired target. Consequently, there is a need for a system and method which simplifies scope mounting and leveling.

BRIEF DESCRIPTION OF THE DRAWINGS

The novel features believed characteristic of the invention are set forth in the appended claims. The invention itself, however, as well as a preferred mode of use, further objectives and advantages thereof, will be best understood by reference to the following detailed description of illustrative embodiments when read in conjunction with the accompanying drawings, wherein:

DETAILED DESCRIPTION

Several embodiments of Applicant's invention will now be described with reference to the drawings. Unless otherwise noted, like elements will be identified by identical numbers throughout all figures. The invention illustratively disclosed herein suitably may be practiced in the absence of any element which is not specifically disclosed herein.

A scope is often mounted to a firearm, such as a rifle, to aid the shooter in aiming at a target. While a rifle will be used as an example, this is for illustrative purposes only and should not be deemed limiting. As discussed, virtually any item which utilizes a scope can utilize the system. To be accurate, scopes must the level to the bore axis of the rifle. If the scope is not level, this can result in extreme inaccuracy, especially at extended ranges.

The bullet and the scope sit on two separate axes which must correctly intersect at a specified point, referred to as the zero point. If the two axes do not align vertically, the scope will no longer intersect the bullet path beyond the zero point after an elevation adjustment to the scope.

Figure 1:
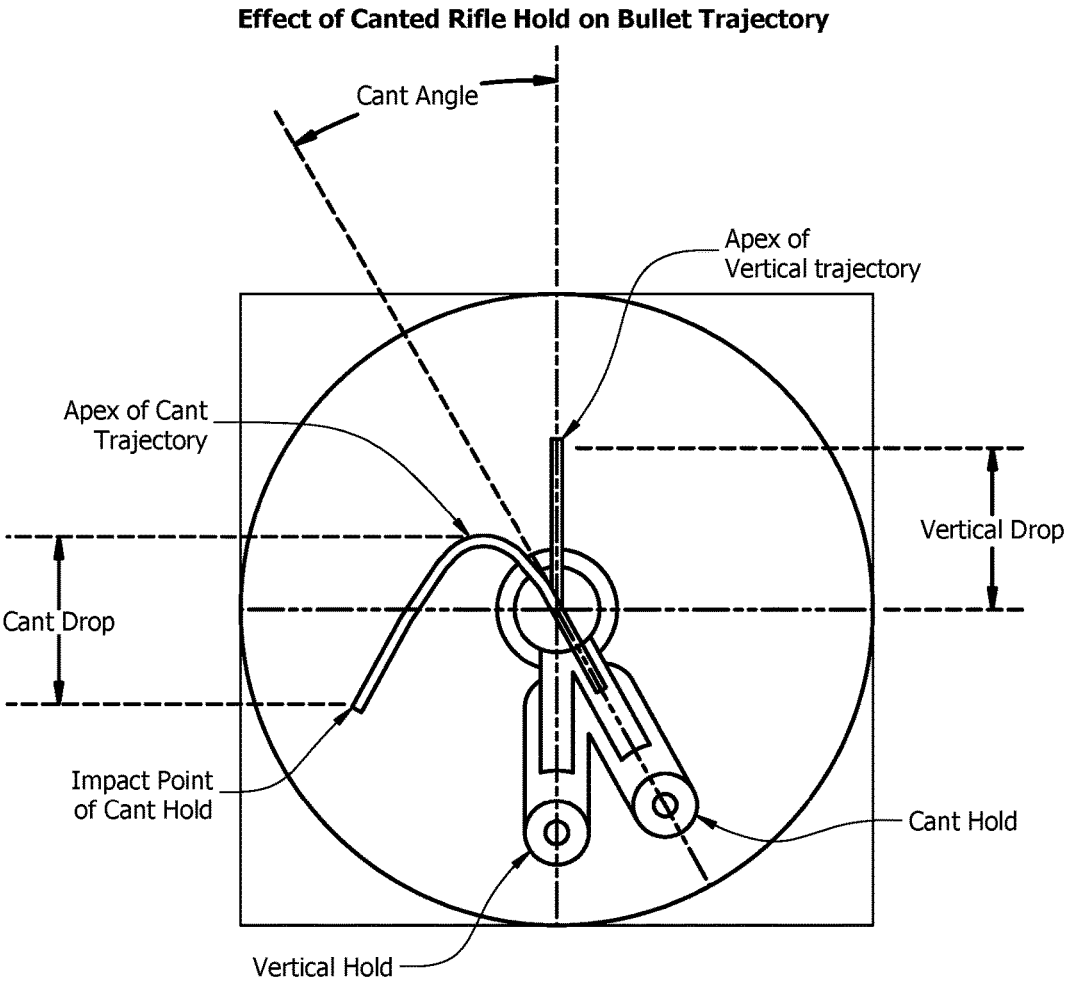
FIG. 1 is a schematic showing the effects of a canted rifle hold on bullet trajectory.

FIG. 1 is a schematic showing the effects of a canted rifle hold on bullet trajectory. As depicted, even though the reticle is still on target and level in the field of view, the rifle is now canted, or tilted, relative to the scope. This results in giving the bullet the angled path, as shown. The vertical hold shows the apex of the vertical trajectory. However, a canted hold, which results if the scope is not level with the rifle, results in an undesirable bullet path which does not hit the desired target. Accordingly, regardless of the accuracy of the scope, if the scope is not level with the rifle, the desired target will not be obtained. As depicted in FIG. 1, the bullet hit below and to the left of the desired target impact.

Figure 2:
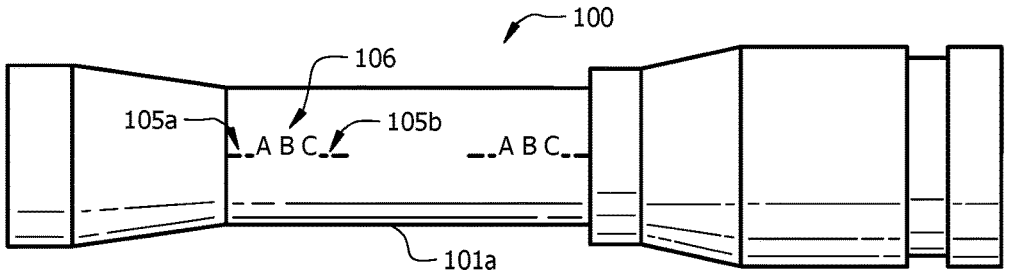
FIG. 2 is a side view of a scope in one embodiment.

FIG. 2 is a side view of a scope in one embodiment. The scope 100 can comprise virtually any scope known in the art. The scope 100 can include various sizes, lengths, shapes, etc. Further, the scope 100 can be attached to the firearm via any method or device known in the art. In one embodiment the scope 100 is not mounted to a rifle which has a picatinny rail.

FIG. 2 shows a front side 101*a* of the scope 100. In one embodiment, the back side 101*b* (not depicted) would look and appear similar.

As depicted, a logo 106 is depicted on the scope 100. The logo can comprise graphics, text, trademarks, etc. which are commonly used to identify the scope manufacturer. While the figure depicts a logo 106, this is for illustrative purposes only and should not be deemed limiting. In other embodiments, for example, no logo is utilized.

In one embodiment, the scope 100 further comprises a leveling indicator 105. A leveling indicator, as used herein, refers to an indicator which when properly aligned demonstrates that the scope is level. The leveling indicator 105 can be located anywhere on the scope. In one embodiment the leveling indicator 105 is located along the body of the scope, which is defined as the area between the opposing lenses. In one embodiment the scope is mounted to the firearm by coupling the firearm to the body of the scope.

In one embodiment the leveling indicator 105 comprises no moving parts or liquids. In one embodiment the leveling indicator 105 is a graphic or text. In one embodiment the leveling indicator is laser engraved into the scope 100. The leveling indicator 105 can comprise a line, or at least two points which can be aligned to indicate when the scope is level relative to a fixed and level surface or part.

In one embodiment, the leveling indicator 105 is an engraved line which extends longitudinally along the length of the scope. The leveling indicator 105 can comprise virtually any shape, thickness, and/or color. The leveling indicator 105, in one embodiment, has a length ranging from about ¼ of an inch to more than one inch.

The leveling indicator 105 can comprise a variety of thicknesses. In one embodiment the leveling indicator 105 is relatively thin to ensure and allow for proper alignment of the scope.

The application of the leveling indicator 105 will be discussed in reference to a ring and mount system. This, however, is for illustrative purposes only and should not be deemed limiting. The leveling indicator 105 can be used with virtually any mounting system which allows the leveling indicator 105 to be used as a reference to ensure the scope 100 is level when properly installed.

Figure 3:
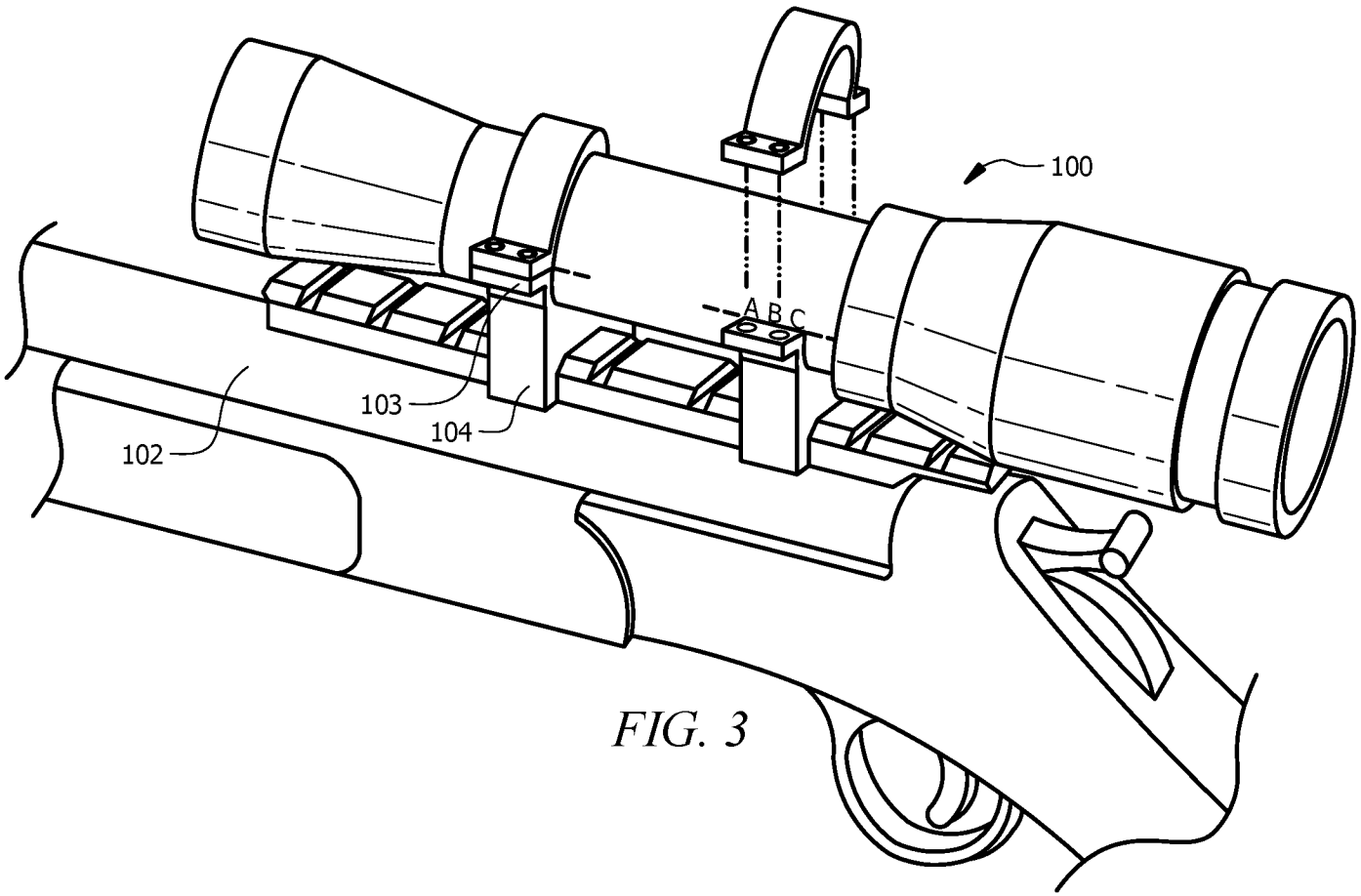
FIG. 3 is a side view of a scope mount in one embodiment.

FIG. 3 is a side view of a scope mount in one embodiment. As depicted, the scope mount 103 comprises an open bottom half-ring. The top half of the ring can be removed, as depicted, by removing screws, bolts, or the like. In other embodiments, the top half is hingedly connected by a hinge or other similar device. The open ring allows a scope 100 to be placed within the open ring. The top ring can then be attached to secure the scope 100 within the mount.

The mount 103 is coupled to the firearm 102 via the coupler 104. The coupler 104 can couple to the firearm 102 via any method or device known in the art.

As noted, the firearm 102 can comprise any firearm which is used to launch or shoot a projectile, such as a bullet.

Figure 4:
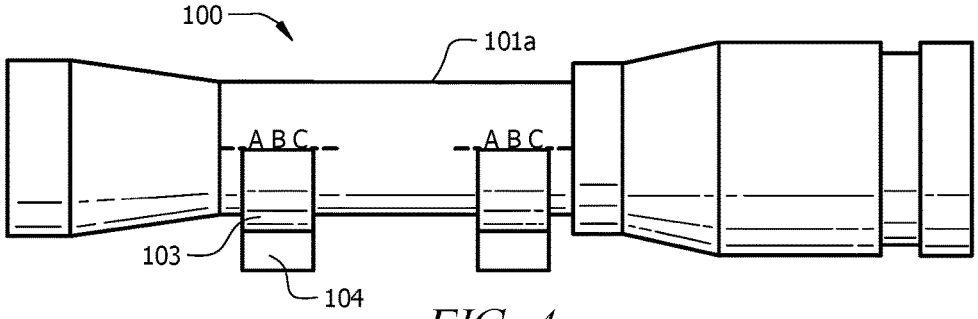
FIG. 4 is a view of a scope mounted in one embodiment.

FIG. 4 is a view of a scope mounted in one embodiment. For illustrative purposes, the top ring has not been secured.

When installing the scope 100, the open bottom ring of the mount 103 is level with the firearm. Accordingly, if the scope 100 is level relative to the mount 103, the scope 100 is likewise level relative to the firearm.

The user can ensure the scope is level relative to the scope 100 by aligning the leveling indicator 105 relative to the mount 103. As shown, the leveling indicator 105 comprises a line running at least a portion of the length of the scope 100. The user can rotate and adjust the scope 100 as necessary to align the leveling indicator 105 so that it is even and level with the top of the open mount 103. The same is conducted on the back side of the scope. The result is a scope 100 that is verifiably level relative to the mount 103 and relative to the firearm.

While the system has been described, a method of utilizing the system will now be described. First, a mount 103 is coupled to a firearm. The mount 103 is coupled via any method or device known in the art. The mount 103 is coupled so as to be level with the firearm. Thus, if the scope is properly installed relative to the mount 103, the scope 100 will likewise be level relative to the firearm.

In one embodiment the mount 103 comprises an open bottom ring. Thereafter, a scope comprising a leveling indicator 105 is inserted into the mount 103. The scope 100 is manipulated, rotated, etc. so as to align the leveling indicator 105 with the top level line of the mount 103. The user repeats the process for the back side. In one embodiment, if the front side is properly aligned, the back side will be automatically properly aligned.

Thereafter, the remainder of the mount 103 can be properly installed to secure the scope 100 within the mount 103.

The system and method discussed herein has several benefits. First, the system and method ensures the scope 100 is properly aligned and level when secured. As noted, this reduces the possibility that the scope 100 will have a canted angle relative to the firearm. This increases accuracy of the scope and the firearm. When accuracy is increased, safety is likewise increased.

Second, the system and method does not require any external parts or tools for the leveling function. Previous attempts to level scopes required complex mounting and leveling applications. These complex tools and applications are eliminated. Instead, the leveling indicator 105 is located on the scope. A user can remove a first scope 100 and replace it with a seconds scope 100 which comprises a leveling indicator 105 without requiring a separate tool for leveling.

Third, the system and method adds built in advantages to the scope 100. These benefits will translate to brand recognition and brand loyalty. Even if a scope were structurally sound, if they are installed incorrectly, accuracy will suffer. This decreased performance will be attributed to the scope manufacturer. However, by increasing the consistency of leveling, and reducing the complexity of leveling the scope, users will have a positive experience with the scope. As noted, this increases brand appreciation and brand loyalty.

As noted, in one embodiment the leveling indicator 105 is engraved within the outer surface of the scope. In other embodiments the leveling indicator 105 is printed onto the surface of the scope 100. In one embodiment the leveling indicator 105 is embedded within the logo 106 of the scope 100. This allows the scope manufacturer to promote the brand without having a separate leveling indicator 105. In other embodiments, however, the leveling indicator 105 comprises a separate line.

In one embodiment the scope 100 comprises a plurality of leveling indicators along its length. As noted, while the leveling indicator 105 has been illustrated as a line, this is simply one example and should not be deemed limiting. In other embodiments the leveling indicator 105 can comprise a series of dots or other design elements which provide a reference point for leveling. As an example, the leveling indicator can comprise an "X" followed by a second "X".

While the invention has been particularly shown and described with reference to a preferred embodiment, it will be understood by those skilled in the art that various changes in form and detail may be made therein without departing from the spirit and scope of the invention.

What is claimed is:

1. A scope for leveling comprising:

a scope body connecting two lenses on opposing ends;

a leveling indicator located on said scope body;

wherein the leveling indicator does not comprise any moving parts wherein said scope body is cylindrical; and wherein said leveling indicator comprises a first horizontal line extending at least a portion of a length of said scope body and an unconnected second horizontal line extending at least a portion of a length;

a first mount comprising a first bottom half-ring, and a second mount comprising a second bottom half-ring;

wherein said first horizontal line aligns with said first bottom half-ring, and wherein said second horizontal line aligns with said second bottom half-ring.

2. The scope of claim 1 wherein said leveling indicator is engraved on said scope body, and wherein said leveling indicator further comprises a logo.

3. The scope of claim 1 wherein said leveling indicator has a length of between about ¼ of an inch to about 1 inch.

4. The scope of claim 1 wherein said scope body is smooth.

5. The scope of claim 1 wherein said leveling indicator is printed on said scope body.

6. A system for leveling, said system comprising:

a scope comprising a scope body connecting two lenses on opposing ends;

a leveling indicator located on said scope body;

at least two mounts for coupling with said scope body, wherein a first mount comprises a first bottom half-ring and a second mount comprises a second bottom half-ring, wherein said first and second bottom half-rings are separated;

wherein said scope body is cylindrical;

wherein said leveling indicator extends horizontally along a length of said scope body;

wherein said leveling indicator aligns with each of first and second bottom half-rings on said mounts when said scope is level;

wherein said leveling indicator comprises a first horizontal line which aligns with said first bottom half-ring, and a second horizontal line which aligns with said second bottom half-ring, and wherein said first horizontal line and second horizontal line are separated, and wherein said leveling indicator comprises no moving parts.

7. The system of claim 6 wherein said first and second half-ring each comprises a semi-circular bottom ring.

8. The system of claim 7 further comprising a removable top ring.

9. The system of claim 6 wherein said mount comprises a level point.

10. The system of claim 6 wherein said scope body is smooth.

11. The system of claim 6 wherein said leveling indicator comprises at least two discrete points which are horizontally separated along said length of said body.

12. A method of leveling a scope, said method comprising:

a) obtaining a scope comprising a leveling indicator, wherein said leveling indicator does not comprise any moving parts, wherein said scope body is cylindrical; and wherein said leveling indicator extends horizontally along a length of said scope body, wherein said leveling indicator comprises a first horizontal line and a second horizontal line, and wherein said first and second horizontal lines are separated;

b) positioning said scope adjacent to a first and a second mount, wherein said first mount comprises a first bottom half-ring and wherein said second mount comprises a second bottom half-ring, wherein said first and second bottom half-rings are separated;

c) manipulating said scope to align said first horizontal line with said first bottom half-ring and said second horizontal line with said second bottom half-ring.

13. The method of claim 12 further comprising a removable top ring.

* * * * *